US006434816B1

(12) United States Patent
Yamamoto et al.

(10) Patent No.: US 6,434,816 B1
(45) Date of Patent: Aug. 20, 2002

(54) METHOD OF ATTACHING A PLUG CAP TO A SPARK PLUG

(75) Inventors: Takao Yamamoto, Saitama; Masanori Shimazoe; Akihiko Kajihara, both of Shizuoka, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/494,516

(22) Filed: Jan. 31, 2000

Related U.S. Application Data

(62) Division of application No. 09/392,481, filed on Sep. 9, 1999, now Pat. No. 6,224,400.

(30) Foreign Application Priority Data

Sep. 9, 1998 (JP) ..... 10-255825
Sep. 9, 1998 (JP) ..... 10-255828
Sep. 11, 1998 (JP) ..... 10-257799

(51) Int. Cl.[7] ..... H01R 43/00

(52) U.S. Cl. ..... 29/825; 29/407.1; 29/407.07; 29/407.09

(58) Field of Search ..... 29/825, 407.1, 29/407.07, 407.09, 407.01, 830–832, 411

(56) References Cited

U.S. PATENT DOCUMENTS 4,082,980 A * 4/1978 Yoshikawa ..... 315/59
4,123,688 A * 10/1978 Yoshikawa ..... 315/58
4,292,841 A * 10/1981 Wesley ..... 73/119
4,534,322 A * 8/1985 Matsuda ..... 123/55
4,640,250 A * 2/1987 Hosaka ..... 123/425
5,048,578 A * 9/1991 Dorf ..... 141/346
5,419,002 A * 5/1995 DeGasperis ..... 15/220.4
5,447,429 A * 9/1995 Nitta ..... 439/125
5,487,676 A * 1/1996 Maruyama ..... 439/125
5,562,477 A * 10/1996 Moore ..... 439/383
5,590,637 A * 1/1997 Motodate ..... 123/634
5,760,533 A * 6/1998 Saiki ..... 313/137
5,859,491 A * 1/1999 Nishikawa ..... 313/141
6,302,712 B1 * 10/2001 Delsole ..... 439/125

FOREIGN PATENT DOCUMENTS

JP U63-60288 4/1988
JP U63-87277 6/1988
JP A5-205844 8/1993
JP A7-106048 4/1995

* cited by examiner

*Primary Examiner*—Carl J. Arbes
*Assistant Examiner*—Sean Smith
(74) *Attorney, Agent, or Firm*—Birch, Stewart, Kolasch & Birch, LLP

(57) ABSTRACT

A plug cap and a method for attaching the plug cap which prevents the occurrence of depressions on a spark plug screw thread and in a cylindrical section of the plug cap. The plug cap includes a spring pin having a straight section which engages a groove in the conductive cylindrical section of the plug cap. The plug cap also has an identifying part on its exterior which indicates the direction in which the straight section is oriented. The plug cap is installed on the spark plug in a way which orients the straight section of the spring pin in a direction parallel to the principle vibration axis of the engine. The base of the plug cap groove may also be cut to a width which dampens the effect of vibrations causing translation of the straight section within the groove. The groove sidewalls may be angled to aid in removal of the plug cap.

14 Claims, 12 Drawing Sheets

METHOD OF ATTACHING A PLUG CAP TO A SPARK PLUG

This application is a division of application Ser. No. 09/392,481, filed Sep. 9, 1999, now U.S. Pat. No. 6,224,400.

BACKGROUND OF THE INVENTION

1. Field of the Invention

The present invention relates to a plug cap for connecting to a spark plug of an internal combustion engine, and more particularly relates to a plug cap configuration which induces less wear of a threaded terminal on the spark plug, and has elements which are resistant to wear.

2. Background Art

Utility Model Laid-Open Publication No. Sho. 63-60288 "Plug Cap" and Utility Model Laid-Open Publication No. Sho. 63-87277 "Attaching Structure for Plug Cap with Integrated Ignition Coil of an Internal Combustion Engine" show conventional plug cap configurations. In FIG. 5 of publication No. 63-60288, a cylindrical member 15 is fixed to a terminal 4*a* by a pin member 17 meshing with the terminal 4*a*. A threaded terminal is shown FIG. 4. In FIG. 3 of publication No. 63-87277 a plug cap is shown which has an integrated ignition coil IC built into a plug cap C. The plug cap C is therefore heavy and the load is borne by a shroud 4 via a seal bar S.

FIGS. 15(*a*) to (*c*) are views describing the operation of a conventional pin member. FIG. 15(*a*) shows a configuration having a straight section 103 of a spring pin housed in a groove 102 of a cylindrical member 101. Member 101 meshes with a screw thread 105 on the terminal side. FIG. 15(*b*) is a view showing the operation when beginning extraction of the cylindrical member 101. When the cylindrical member 101 is moved upwards, a force in the direction of arrow A acts on the straight section 103. This force is orthogonal to an inclined surface of the screw thread 105, and when the force changes direction to that of direction of arrow B, a horizontal component of this force is generated in the direction of arrow C. The straight section 103 then pushes out towards the left due to the horizontal component of the force in the direction of arrow C. As a result, as shown in FIG. 15(*c*), the straight section 103 moves as far as the top of the screw thread 105, and the cylindrical member 101 is withdrawn in the direction of the vertically extending arrow.

FIGS. 16(*a*) to FIG. 16(*c*) are views showing difficulties arising in the use of conventional plug caps. FIG. 16(*a*) shows depressions 106 that are generated by the hard straight section 103 wearing upon the relatively soft screw thread 105 during long periods of use. As shown in FIG. 16(*b*), when it is intended to withdraw the cylindrical member 101 upwards, the straight section 103 cannot be moved horizontally (in the direction X in the drawings) by applying force to the straight section 103 in the direction of arrow A, due to the depth of the wear-induced depressions 106.

FIG. 16(*c*) is an enlarged view of FIG. 16(*b*). In this figure it can be seen that when the center of the straight section 103 reaches, for example, a point P2 which is further inward than point P1, the straight section 103 cannot now be pushed horizontally. Conversely, if the center of the straight section 103 is further left of or outward from point P1, lateral movement is still possible. However, after long periods of use, it is possible that the center of the straight section 103 will reach point P2 inward from point P1. Regarding this point, in the case of a plug cap integrally fitted with an ignition coil as in Publication No. Sho. 63-87277, in order to fix the plug cap to the terminal in a reliable manner, it is necessary to make the spring force of the pin member large. When the spring force is large, the wear of the screw threads occurs after a relatively short period of time.

In the above, a description is given of wear on the side of the threaded terminal of the spark plug, but the same also occurs on the side of the cylindrical member of the plug cap.

FIGS. 17(*a*) and FIG. 17(*b*) are views showing examples of deficiencies in conventional cylindrical members. FIG. 17(*a*) shows that the width of the groove 102 is substantially the same as the diameter of the straight section 103. This straight section 103 moves up and down so as to knock against an upper sidewall 107 and a lower sidewall 108 in during vibration. As a result, as shown in FIG. 17(*b*), the sides of the relatively soft sidewalls 107 and 108 are deformed and a so-called tadpole shape is formed. The straight section 103 meshes as a result of movement to the right in the drawings and is released as a result of movement to the left. Movement to the left is therefore indispensable if the cylindrical member 101 is to be detached.

In FIG. 17(*b*), as the straight section 103 is inserted into a concave part 109, it is necessary to apply quite a large force in order to cause movement in the direction of the arrow 3. The operability of the configuration of FIG. 17(*a*) is therefore low and this configuration is not preferred. As shown by these illustrations, conventional configurations are seen to develop a considerable reduction in operability after extended use.

SUMMARY OF THE INVENTION

It is therefore an object of the present invention to prevent the occurrence of depressions at the screw threads on the terminal side.

It is further an object of the present invention to prevent the occurrence of depressions in a groove on the side of a cylindrical section.

It is an additional object of the present invention to prevent a reduction in operability in detaching the plug cap.

In order to achieve the aforementioned objects, a plug cap attachment method is disclosed utilizing a plug cap having a conductive section covering the threaded terminal, a groove cut to a fixed depth from the outer surface of a cylindrical section towards the center thereof, and an alignment section of an attachment element installed at the groove. The attachment element may be a spring pin having a substantially straight section serving as the alignment section. The straight portion of the spring pin meshes with the threaded terminal, with the threaded terminal located on a spark plug installed in an internal combustion engine. The spark plug is typically installed in a manner substantially parallel to the cylinder axis of an ignition chamber. When the plug cap is connected to the spark plug, the straight section of the spring pin lies in a plane orthogonal to the axis of a crank shaft of the internal combustion engine.

Vibrations of the internal combustion engine mainly occur in a plane orthogonal to the axis of the crankshaft. Therefore, when the straight section of the spring pin is arranged in this plane, the threaded terminal is arranged in parallel with this surface. External force therefore operates in each direction in this plane but external forces do not generally operate in directions orthogonal to this plane. Because the external force does not operate in a direction orthogonal to this plane, there is no knocking of the screw thread and no danger of depressions being created at the screw thread.

The internal combustion engine can be mounted on a vehicle in such a manner that the crankshaft extends across the width of the vehicle and the cylinders are above the axis of the crankshaft. A main direction of vibration of the internal combustion engine is therefore substantially orthogonal with the cylinder axis and the axis of the crankshaft, and the straight section of the spring piston extends in parallel with the main direction of vibration. Because the straight section is parallel to the direction of vibration, external force does not operate in a direction orthogonal to the pin axis, and there is no danger of knocking at the screw thread or at sidewall grooves. There is accordingly no danger of depressions occurring at the screw thread or groove sidewalls.

The main direction of vibration of the internal combustion engine is typically in a direction from the front to the back of the vehicle, the cylinder axis of this internal combustion engine being substantially vertical and the straight section of the spring pin extending substantially in a direction from the front to the back of the vehicle.

In addition to there being no danger of depressions occurring in the screw threads and the sidewalls of the grooves, it is also anticipated that unpleasant vibrations sensed by a motorcycle rider will be substantially reduced. If a seat is located above an inclined engine in a motorcycle in which the principal vibrations from an engine are vertical, this provides an unpleasant feeling during riding. If the direction of vibration is then made from the front to the rear of the vehicle, the unpleasant vibrations are substantially reduced.

The present invention also involves a plug cap having a conductive cylindrical section into which a threaded terminal of a spark plug is screwed and incorporated at the lower part of a cap body. A groove is cut into the cylindrical section to a fixed depth, with a straight section of the spring pin installed at the groove and meshing with the threaded terminal. An identifying part for identifying the direction of the straight section is formed in the cap body. The occurrence of depressions in threaded terminals can be suppressed by lining up the direction of attachment of the straight section of the spring pin with the direction of the vibrations acting on the spark plug and plug. However, the spring pin and the straight section thereof are within the cap body and their orientation cannot be determined from the exterior of the plug cap. The identifying part is therefore provided as a mark, such as an arrow, a character, a color, an indentation, a raised surface or surfaces, a luminescent element, or other identifying indicia on the cap body, to provide an indication of the proper orientation of the cap body from the exterior.

The cap body may comprise a cylindrical section with a conductive cylindrical section built in the body, and a connector for inserting a plug for supplying electricity to the conductive cylindrical section from outside. The connector can include the identification section because the connector extends from the cylindrical section at a right angle to the axis of the cylindrical section.

A method of applying an identifying mark is also disclosed, in which characters or a color are applied to the cap body as an identification part. If the connector itself is used as an identification part indicating direction at the cap body, increases in costs can be kept down while maintaining an attractive appearance. in this case the cap body or an element of the cap body lies in a predetermined alignment with a straight section of a securing spring pin or pins within the plug cap. The element having a predetermined alignment is then used to determine the proper alignment when installing the plug cap in relation to the primary direction of vibration of the engine.

The ignition coil can include a primary coil and a secondary coil which is built into the cap body. The plug cap having an integrated ignition coil is substantially heavier than those having an external transformer function. The spring force of a securing spring pin must therefore be increased to reliably fix the cap to a threaded terminal. This increase in spring force results in a striking increase in the occurrence of depressions in the screw thread and depressions in the groove. However, in the present invention, even a plug cap with an integrated ignition coil can be reliably attached to a screw terminal by lining up the direction of vibration applied from outside and the axial direction of the pin of the straight section of the spring pin. In addition, depressions do not occur and detachment from the spring terminal is straightforward.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5(*b*) is a view illustrating the operation of a groove according to the first embodiment of the present invention;

DETAILED DESCRIPTION OF THE PREFERRED EMBODIMENTS

Figure 1B:
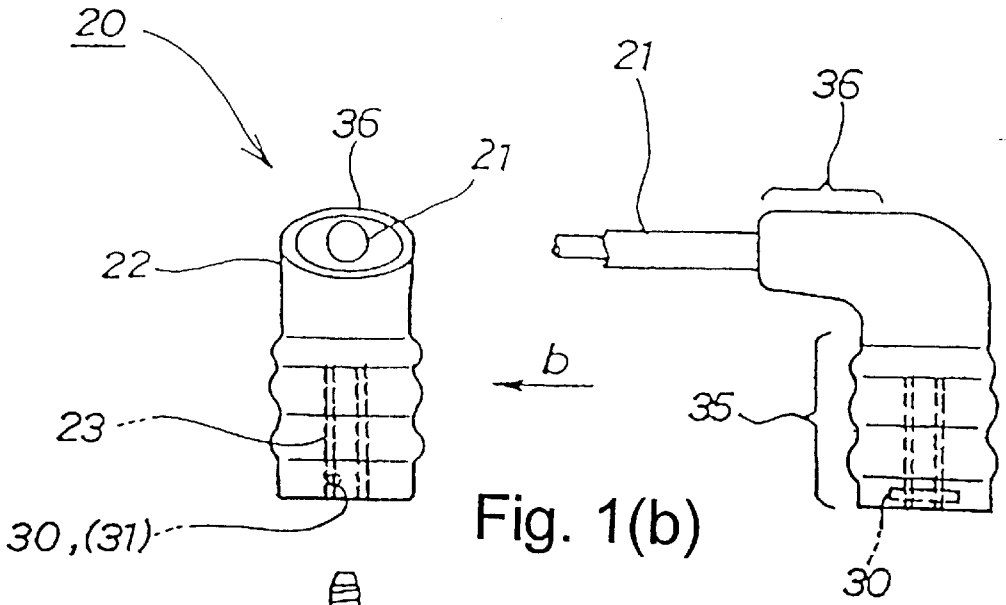
FIGS. 1(*a*) and 1(*b*) are views showing the relationship between the plug cap and park plug according to a first embodiment of the present invention.
Figure 1A:
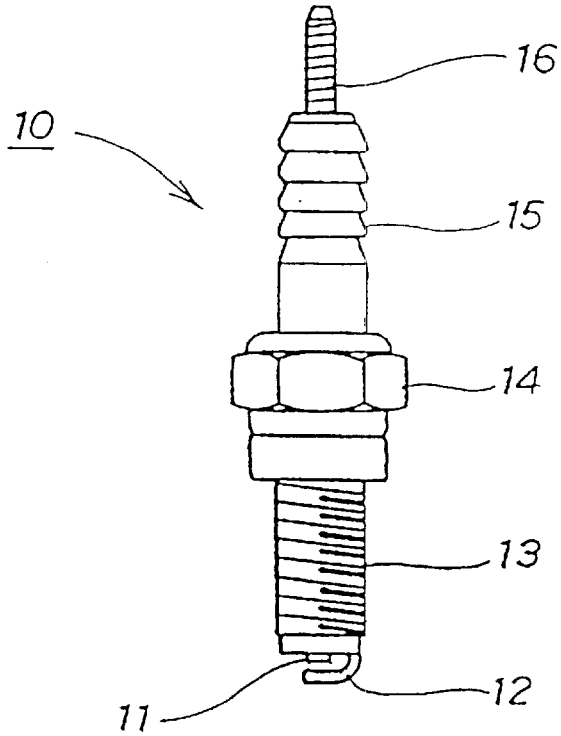

FIG. 1(*a*) is a view showing the relationship between a plug cap and a spark plug according to a first embodiment of the present invention. FIG. 1(*b*) is a view in the direction of arrow b of FIG. 1(*a*). The spark plug 10 is a plug appropriate for use in a standard internal combustion engine. Plug 10 has a threaded terminal, a central electrode 11, an outer electrode 12, threaded installation section 13, nut 14, insulator 15 and threaded terminal 16. At a plug cap 20, numeral 21 indicates a high tension cable, numeral 22 an insulating cap body, and numeral 23 a conductive cylindrical section.

The cap body 22 comprises a cylindrical part 35 incorporated into the cylindrical section 23, with an identifying part 36 bent at a right angle to the cylindrical part 35. This identifying part 36 extends in a direction parallel to the straight section 31 of the spring pin 30, and serves as an indicator of the proper orientation of straight section 31.

Figure 2:
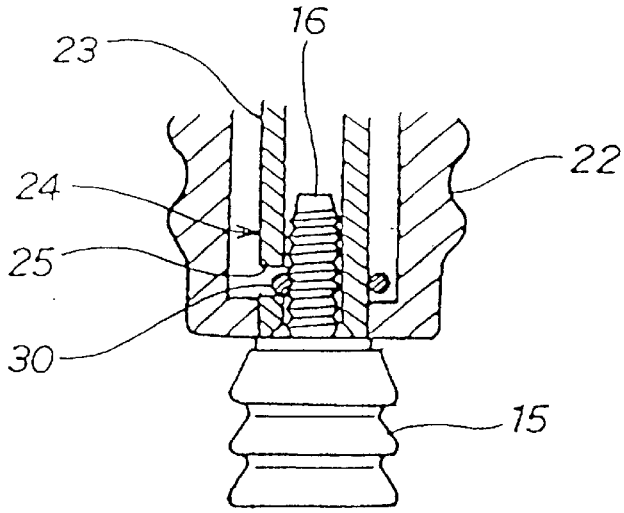
FIG. 2 is a cross-sectional view of the attachment configuration for the plug cap according to the first embodiment of the present invention.

FIG. 2 is a sectional view of the installation configuration for the plug cap according to the first embodiment of the present invention. Here, a spring pin 30 is installed in a groove 25 cut to a fixed depth in a direction towards the center from an outer surface 24 at the end (lower end) of the cylindrical section 23. The spring pin 30 meshes with the thread of the threaded terminal 16.

Figure 3A:
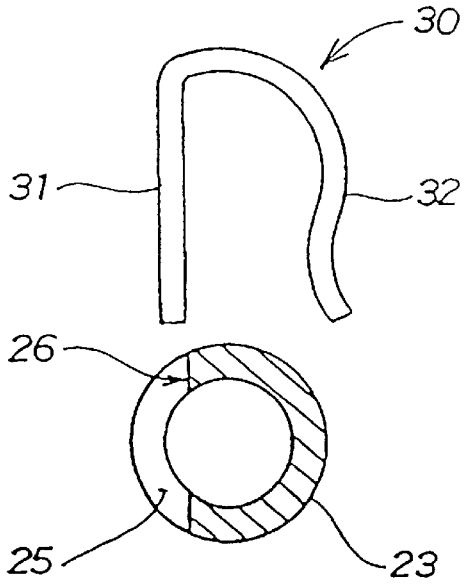
FIGS. 3(*a*) and 3(*b*) are views showing the elements involved in attaching the spring pin according to the first embodiment of the present invention.
Figure 3B:
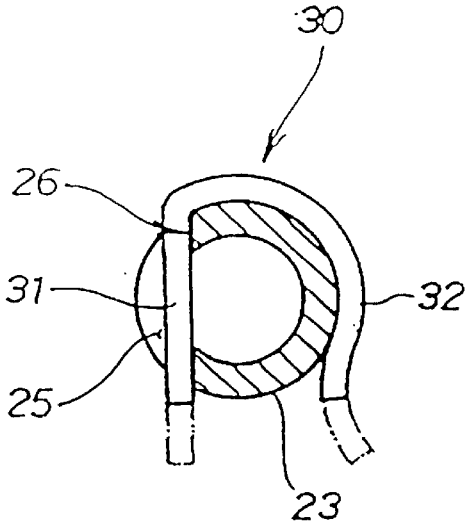

FIG. 3(*a*) and FIG. 3(*b*) are views of the elements involved in the installation of the plug cap of the present invention. In FIG. 3(*a*), a spring pin 30 is lined up with the groove 25 of the cylindrical section 23. The spring pin has a shape resembling that of a hairpin, with a is straight section 31 and a curved section 32 bent back from an end of the straight section 31. Spring pin 30 may be formed from a steel or other metal which has a high hardness value when compared with carbon steel or stainless steel.

In FIG. 3(*b*), the straight section 31 is illustrated as meshed with the groove 25, and curved section 32 is wrapped around the cylindrical section 23. Excess material is shown by imaginary lines and may be removed using a cutting tool. Straight section 31 therefore runs along the groove 25 and can translate along the groove. The section remains biased against the base 26 of the groove 25 as shown in FIG. 3(*b*) if there is no external force.

Figure 4:
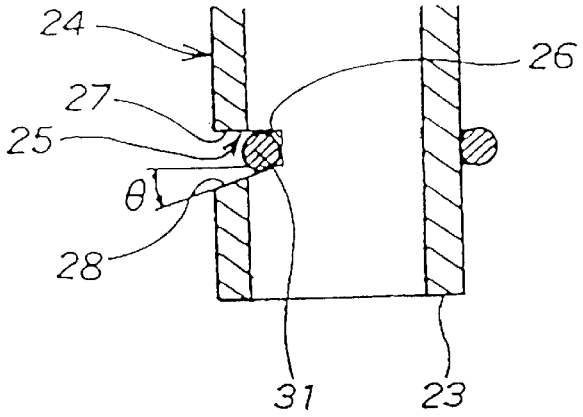
FIG. 4 is an enlarged sectional views of a groove according to the first embodiment of the present invention.

FIG. 4 is an enlarged view of the groove according to the first embodiment of the present invention. The groove 25 comprises a base 26, and upper and lower sidewalls 27 and 28 and is characterized in that lower sidewall 28 is inclined so as to broaden out towards the outer surface. The angle of inclination θ can be in the range of 10 to 20 degrees, with 15 degrees being a preferred value. Only sidewall 28 of the two sidewalls 27 and 28 is inclined with respect to the groove 25, thus forming a V-shape in which one side of the groove may be essentially orthogonal to the longitudinal axis of the cylindrical section. The groove 25 is therefore referred to as having a V-shaped cross-section with one side vertical.

Figure 5A:
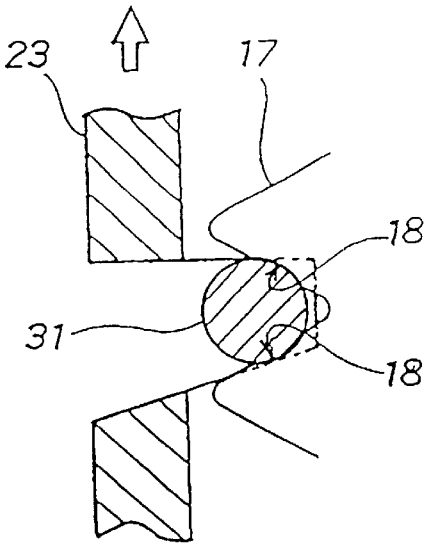
FIG. 5(*a*) is an enlarged sectional view of the operation of a groove according to the first embodiment of the present invention.
Figure 5B:
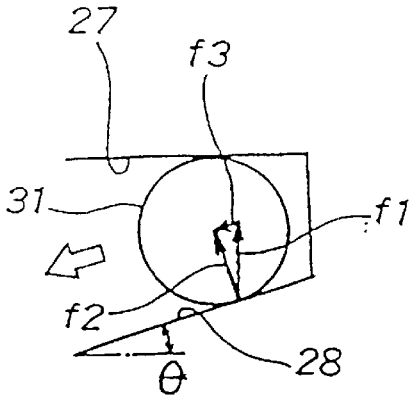

FIG. 5(*a*) and FIG. 5(*b*) are views illustrating the operation of a groove according to the first embodiment of the present invention. In FIG. 5(*a*), depressions 18 are generated in the inclined surface of the relatively soft screw thread 17 by the hard straight section 31 due to use over long periods of time. The arrow indicates a force in the direction of withdrawal for the cylindrical section 23 in this state.

In FIG. 5(*b*), an upward force f1 operating on the straight section 31 can be divided into a vertical component force f2 at the sidewall 28 and a component of force f3 which is parallel to sidewall 28. The straight section 31 is then urged in a direction towards the outside by the component of force f3 as shown by the large arrow. As a result, the straight section 31 comes away from the screw thread 17 of FIG. 5(*a*) and movement upwards from the cylindrical section 23 is possible.

To demonstrate this operation, it is preferable to select θ in a range from 10 to 45 degrees. If θ is less than 10 degrees, then there is little difference from a groove having vertical sidewalls, and the force required to push the straight section 31 to the outside is only slight. If 45 degrees is exceeded, in addition to force being applied in the left direction to the straight section 31, there is the danger that the straight portion will become unstable. This is due to the clearance with respect to the plug cap insertion direction for the straight section 31 and the groove 25 in the case of extension to the outside (or, to the left in the drawing figure). Because manufacturing is easier for a smaller θ, it is preferable to limit θ to about 20 degrees, and it is even more preferable to select θ within a range of from about 10 to 20 degrees.

Figure 6B:
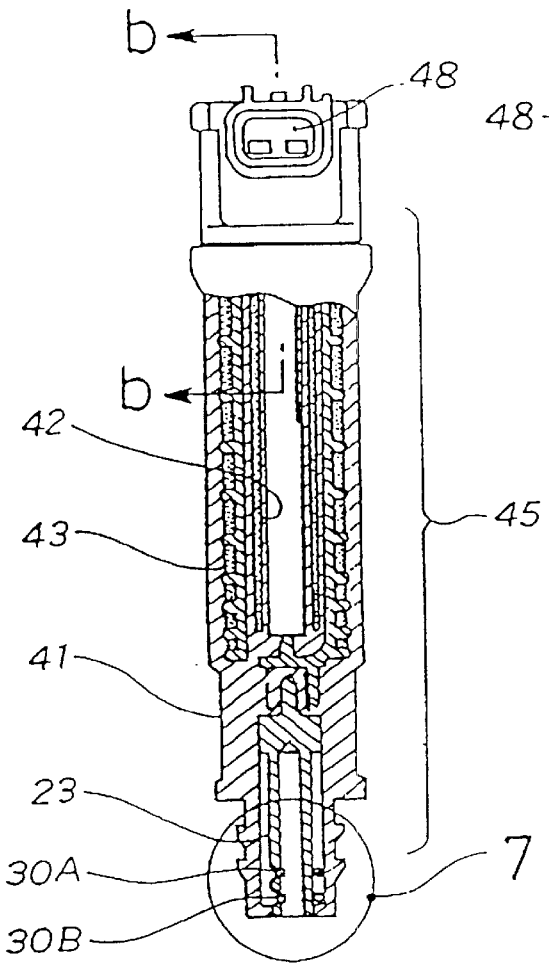
FIGS. 6(*a*) and 6(*b*) are a sectional views of a plug cap along with a spark plug according to a second embodiment of the present invention.
Figure 6B:
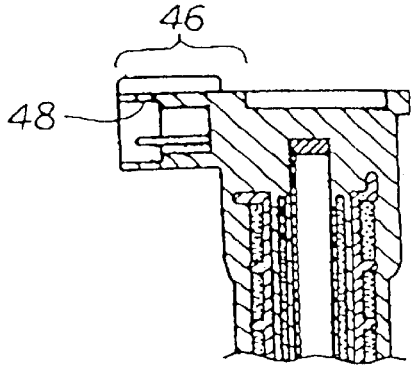
Figure 6A:
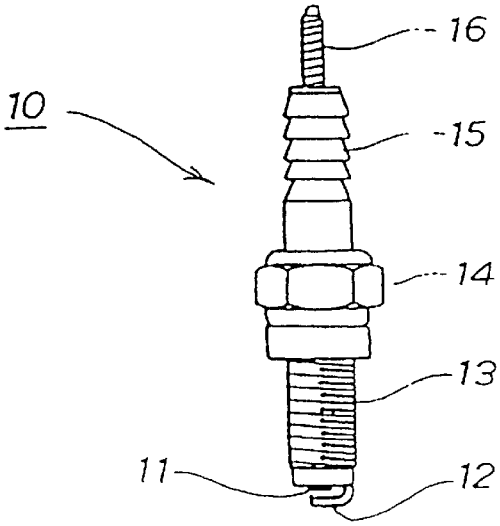

FIG. 6(*a*) is a cross-section of a plug cap according to a second embodiment of the present invention, with FIG. 6(*b*) being a cross-section taken along line b—b of FIG. 6(*a*). Here, the spark plug 10 can be a plug with a threaded terminal as illustrated in FIG. 1. Plug cap 40 is integrally formed with an ignition coil, where a first coil 42, second coil 43 and cylindrical section 23 are housed in an insulating cap body 41. A high voltage ignition transformer is formed by the first coil 42 and the second coil 43. The first coil 42 and the second coil 43 must be wound to a required length and the cap is therefore elongated.

The cap body 41 includes a cylindrical part 45 incorporated in the cylindrical section 23, with an identifying part 46 formed so as to extend from the cylindrical part 45 in a direction at right angles to the longitudinal axis of the cylindrical part 45. A connector 48 for inserting a plug for supplying electricity is formed at the identifying part 46. In this case, connector 48 doubles as the identifying part 46 because it extends at a right angle from the longitudinal axis of cylindrical part 45. The identifying part 46 extends in a direction parallel to the straight section of the spring pins 30A and 30B (in FIG. 6(*a*) this extends from the rear in a forward direction), and therefore indicates the orientation of the straight sections of the spring pins 30A and 30B.

An arrow pattern may be applied to the identifying part 46 of the plug cap, or characters or a color may be applied to the cap body 41. If the connector 48 is also used as an identification part indicating orientation at the cap body 41, as shown in FIGS. 6(*a*) and 6(*b*), cost may be minimized while maintaining an attractive appearance. The connector itself can serve as the identification part by constructing the plug cap so that the connector has an orthogonal orientation with respect to the cylindrical conductive section 23, and a predetermined relationship with respect to the direction of straight portion 31, as in a parallel relationship.

Figure 7:
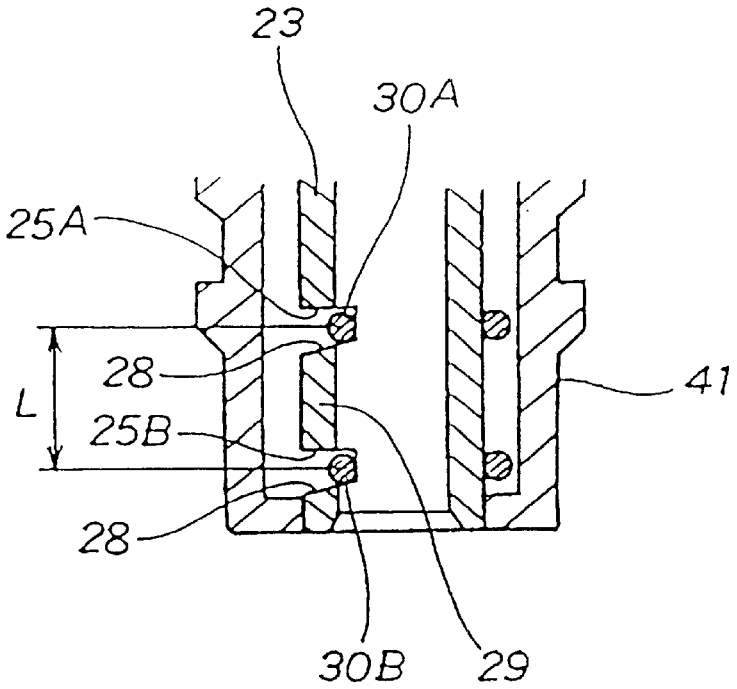
FIG. 7 is a detailed view of part 7 of FIG. 6(*a*)

FIG. 7 is a detailed view of part 7 of FIG. 6. Here, a first groove 25A and a second groove 25B are spaced at a prescribed distance L in parallel with each other on cylindrical section 23. A first spring pin 30A and a second spring pin 30B are installed within the grooves. The first groove 25A and the second groove 25B may have the same shape as groove 25, and the first spring pin 30A and the second spring pin 30B may have the same shape as spring pin 30. The first and second grooves 25A and 25B are grooves of a V-shaped cross-section with one side vertical and with the lower sidewalls 28 both being inclined. As a result of these grooves having a V-shaped cross-section with one side vertical, installation requires a slight force and withdrawal is relatively easy. However, the first and second grooves 25A and 25B can both be grooves of a V-shaped cross-section with two inclined sidewalls. If a groove having two inclined sidewalls is used, both attachment and withdrawal can both be completed with only a small amount of force. However, this configuration cannot be employed when distance L is small due to the requirement for a remainder portion 29 between the first channel 25A and the second channel 25B.

Figure 8:
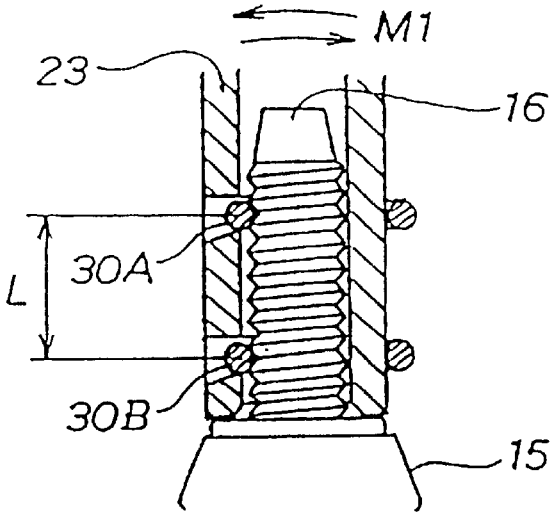
FIG. 8 is a view of the operation of a plug cap of the second embodiment.

FIG. 8 is a view of the operation of a plug cap according to a second embodiment of the present invention, where a large moment M1 is applied to the cylindrical section 23. The cylindrical section 23 advantageously forms a two point support structure with the first spring pin 30A and the second spring pin 30B separated by a distance L. In a one point support structure the moment Ml that can be supported is weak, while in a two point support structure a larger moment can be supported.

Figure 9:
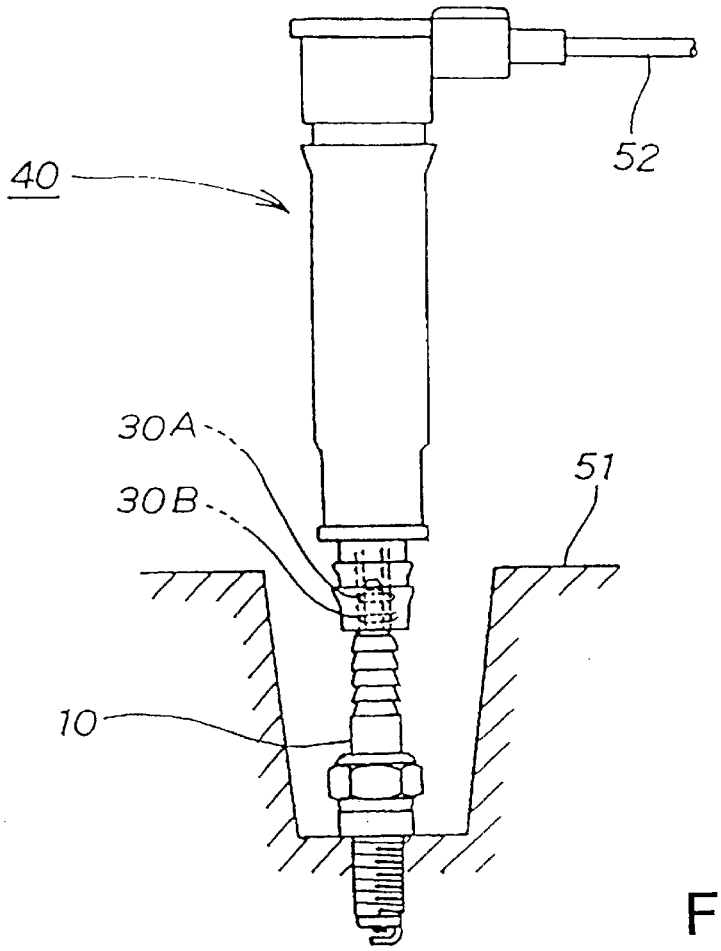
FIG. 9 is a view a plug cap according to the second embodiment as installed on a cilinder head.

FIG. 9 is a view of the attachment of plug cap 40 to a spark plug 10 which is threaded into a cylinder head 51 according to the second embodiment of the present invention. First spring 30A and second spring 30B engage grooves within a cylindrical section and secure the plug cap 40 to the spark plug 10. A low tension cable 52 is connected to the plug cap 40. The plug cap 40 includes a primary coil and a secondary coil. Because a transformer function is built into the plug cap 40, it is sufficient to supply low voltage current to cable 52. The wire adopted for the cable 52 can therefore be relatively thin compared with a high tension cable. Because the cap with an integrated coil is substantially heavier than caps having an external transformer function, the spring pin force must be made fairly large to support the plug cap. The occurrence of depressions due to the large spring force can be prevented by aligning the axial direction of the straight portion 31 of a spring pin 30 with the direction of vibration. It is therefore not necessary to support the plug cap 40 with a separate bracket, in spite of the elongated shape of plug cap 40. In FIG. 9, two spring pins 30A and 30B are employed to more securely fix the plug cap 40 having an integral transformer function to the spark plug 10. Various embodiments employing varying numbers of spring pins and varying spring forces are contemplated as encompassed by the present disclosure.

Figure 10:
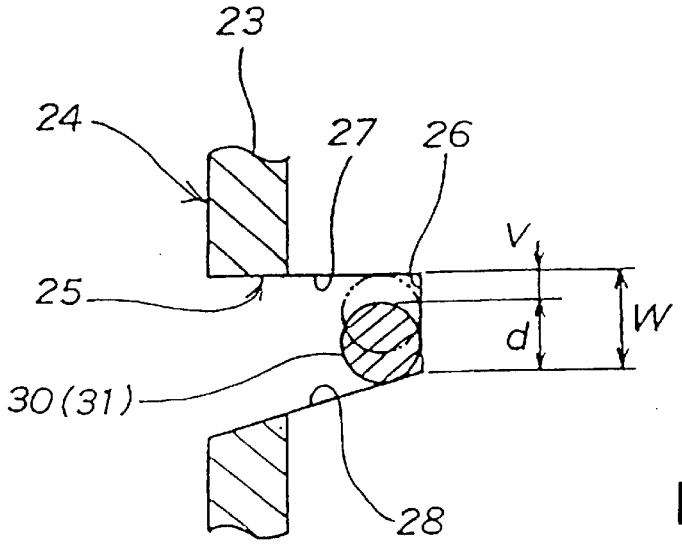
FIG. 10 is a sectional view of a groove according to a third embodiment of the invention.

FIG. 10 is an embodiment of a groove according to a third embodiment of the present invention. The width W of the base 26 of the groove 25 is usually sufficiently larger than the diameter d so as to provide a slight clearance with the diameter d of the straight section 31. Particularly when the width of the base 26 of this groove 25 is taken as W, the diameter of the straight section 31 is taken to be d, and the amplitude of vibration of the plug cap occurring due to vibrations of the engine taking the spark plug as a reference are taken to be V. W is then calculated as W=d+V. The width is calculated according to this formula to compensate for the delay between the vibration of the plug cap and the spark plug. This delay occurs because the spark plug vibrates in unison with the cylinder head, by way of its rigid attachment with the cylinder head. On the other hand, the spark plug cap is not absolutely rigid in relation to the spark plug, and therefore vibrates in a manner that is slightly delayed with respect to the spark plug. The delay is more striking for plug caps of a larger mass and in particular tends to be particularly large for plug caps with integrated ignition coils, with this delay appearing as an amplitude. The range of this amplitude therefore becomes the extent to which the hard straight section 31 knocks the sidewalls 27 and 28 of the groove 25, thereby damaging the sidewalls and making it difficult to detach the plug cap.

As shown in FIG. 10, if the channel width is compensated according to an expected amplitude V, calculated by the formula W=d+V, there is no danger of knocking at the sidewalls 27 and 28. The application of the groove structure using base width values as calculated in the third embodiment is therefore desirable and applicable to the first and second embodiments of the present invention. Giving a specific example, when four 150 cc cylinders are lined up in series to give a 600 cc water-cooled four cylinder internal combustion engine, the amplitude V is 0.1 to 0.3 mm and the pin diameter is 0.9 mm. It is therefore preferable to select a groove width W in a range from 1.0 to 1.2 mm.

Two grooves are shown in the illustration of the third embodiment, but if the distance L is sufficient, three or more grooves may be employed. The groove 25 can also be constructed with a V-shaped cross-section where the upper sidewall 27 is also inclined so as to broaden towards the outer surface. If this V-shaped cross-section is adopted, installation and removal are both fairly easy. The amplitude V changes depending upon the type and shape of the engine, and the shape and weight of the plug cap. Values for amplitude V can be determined through experimentation and then revising these experimental values based on practical data. It is also possible to combine the inclining of the sidewalls of the grooves as described in connection with FIG. 4 and the base width value W in relation to the amplitude V as described in connection with FIG. 10.

Figure 11:
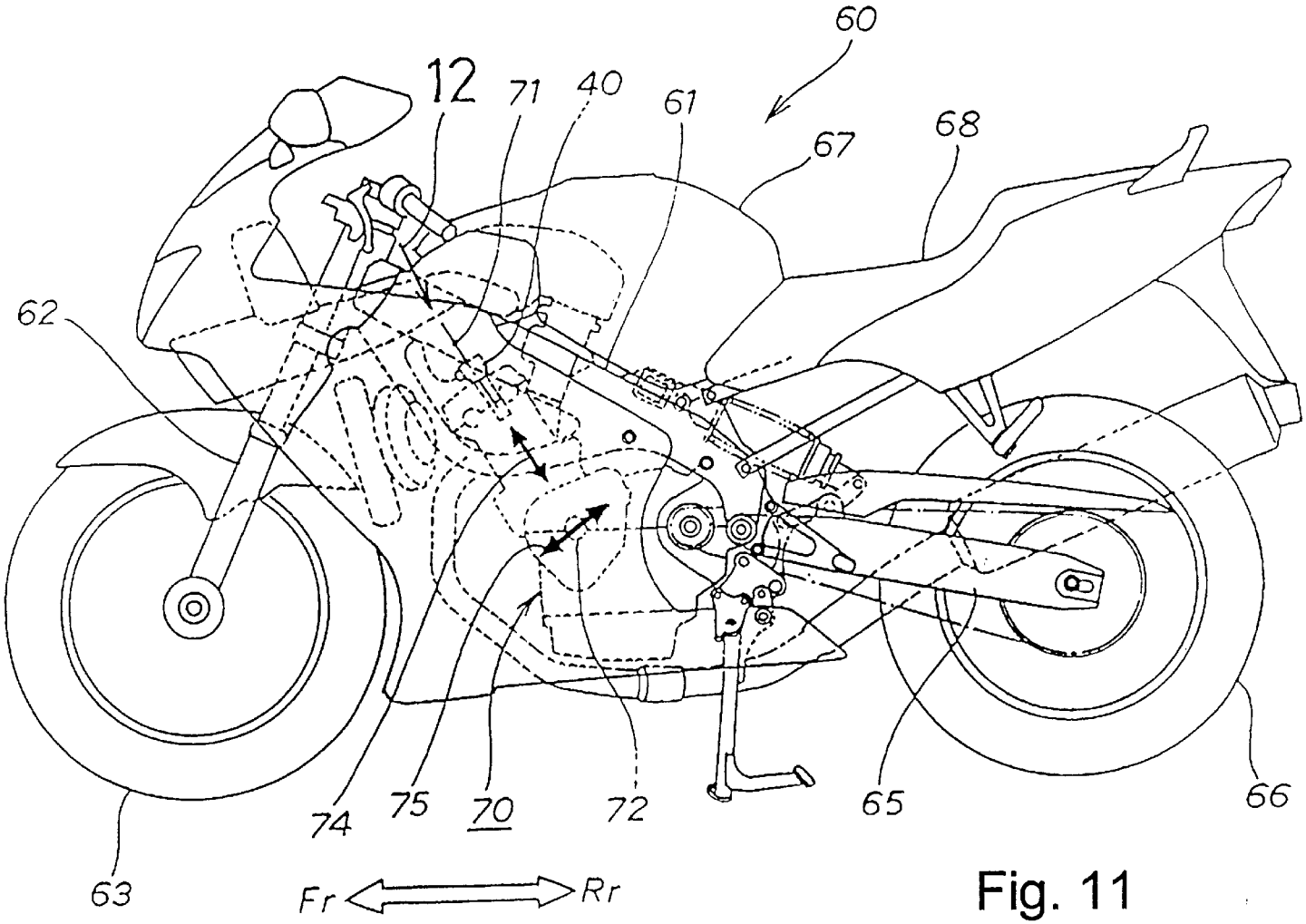
FIG. 11 is a side view of a motorcycle to which the plug cap attachment method of the present invention may be applied.

FIG. 11 is a side view of a motorcycle to which the plug cap attachment method of the present invention is applied. Here, a motorcycle 60 has a front wheel 63 attached to a front part of a vehicle frame 61 via a front fork. A rear wheel 66 is attached to the rear part of the vehicle frame 61 via a swing arm 65. A fuel tank 67 and seat 68 are then lined up from front to rear above the vehicle frame 61 and an internal combustion engine 70 is arranged below the fuel tank 67 and the seat 68. The engine 70 is arranged in such a manner that the cylinder axis 71 is inclined slightly forwards from the vertical, with the spark plugs arranged on the cylinder axis facing the ignition chamber (not shown in the drawings). A plug cap 40 is attached to each plug and a crankshaft 72 extends across the vehicle (shown from inside to outside in the drawings). At the engine 70, a first vibration 74 caused by the reciprocal movement of the piston is generated. This vibration exhibits itself in the negation of the crankshaft weight and as a result, a second vibration 75 in a direction orthogonal to the first vibration 74 becomes the principal vibration. The second vibration 75 therefore becomes a vibration going from the front slightly to the rear of the vehicle because the cylinder axis 71 is inclined slightly forward from the vertical.

In the present invention, the plane of FIG. 11 (i.e. the plane of the paper) corresponds to a plane orthogonal to the axis of the crankshaft. Similarly, in the present invention, arrow 75 corresponds to a direction which is substantially orthogonal to the cylinder axis and substantially orthogonal to the axis of the crankshaft. If the main vibrations from the engine 70 are vertical vibrations, then the sensation when riding is unpleasant due to the relationship of the seat 68 on the incline of the engine 70. It is therefore preferable for the direction of vibrations to be substantially from the front to the rear of the vehicle.

Figure 12:
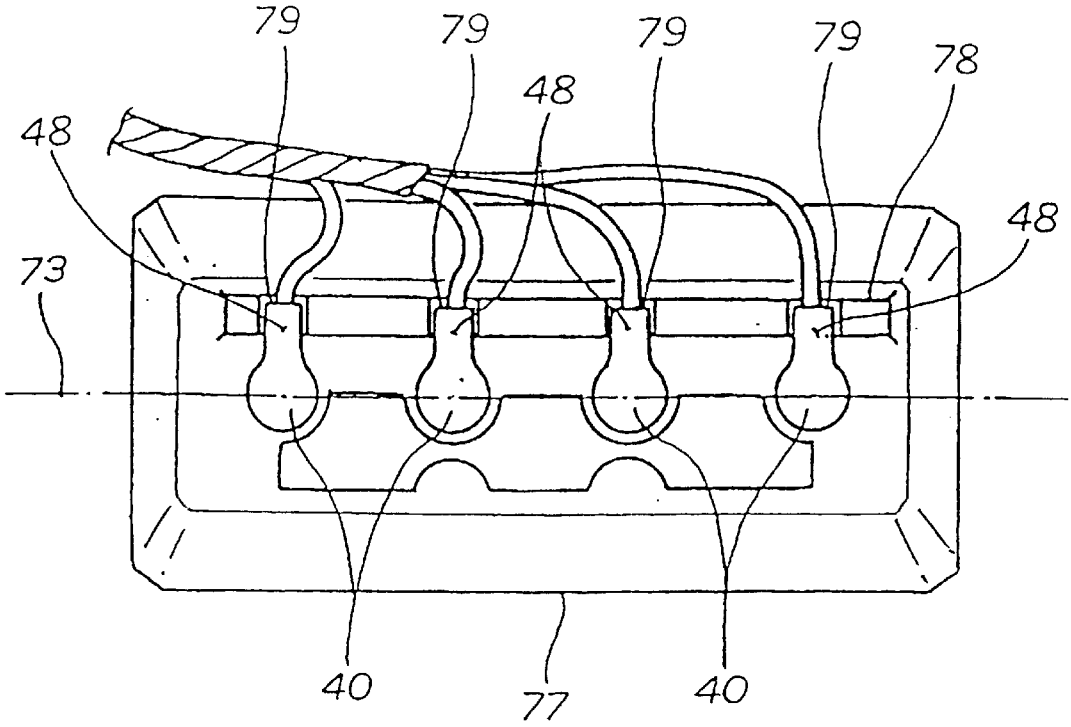
FIG. 12 is a view in the direction of the arrow 12 of FIG. 11.

FIG. 12 is a view as viewed from arrow 12 of FIG. 11, including four plug caps 40 arranged on plugs installed in head cover 77, together with plug cap connectors 48 which all face towards the front of the vehicle. Numeral 73 indicates the crankshaft axis. As a result, a guide rib 78 rises at the front edge of the head cover 77 and four guide grooves 79 are cut into the guide rib 78. The orientation of the connectors 48 can then be arranged by inserting each of the connectors 48 into the guide grooves 79.

Figure 13A:
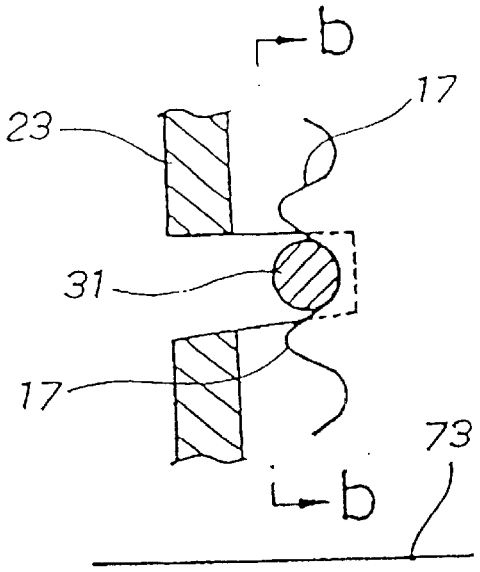
FIG. 13 is a view of a first action of the plug cap attachment structure of the present invention.
Figure 13B:
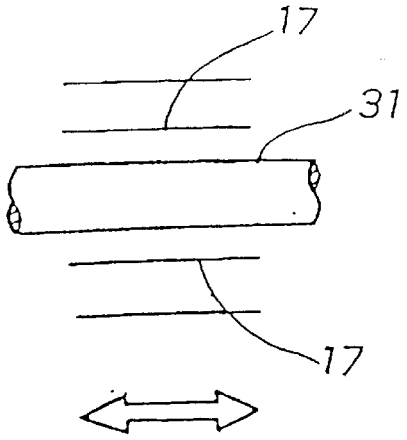

FIG. 13(*a*) and FIG. 13(*b*) are views of a first action of the plug attachment structure of the present invention. FIG. 13(*a*) is a view showing the relationship of the threaded terminal and the straight section 31 of the spring pin as viewed from the front of the vehicle, illustrating the straight section 31 as meshed with the depressions of the screw threads 17.

FIG. 13(*b*) is a view taken in the direction of arrow b—b of FIG. 13(*a*) with the large bidirectional arrow showing the direction of vibrations due to external forces. This shows that the straight section 31 is parallel or substantially parallel with this direction of vibration. If the direction of the main vibrations of the engine is a direction from the front to the rear of the vehicle, the straight section 31 extends parallel or substantially parallel to this direction. This alignment of the straight section 31 prevents wear due to frictional contact with the screw threads 17. Specifically, the reciprocal motion of the straight section in a direction which is substantially aligned with the screw threads, which does not result in the formation of depressions.

In a vehicle employing the present invention, an internal combustion engine may be mounted on a vehicle in such a manner that the crankshaft extends across the width of the vehicle and cylinders are above the axis of the crankshaft, a main direction of vibration of the internal combustion engine is expected to be orthogonal with the cylinder axis and the axis of the crankshaft. The straight section 31 of the spring piston 30 therefore extends substantially in parallel with the main direction of vibration.

Figure 14A:
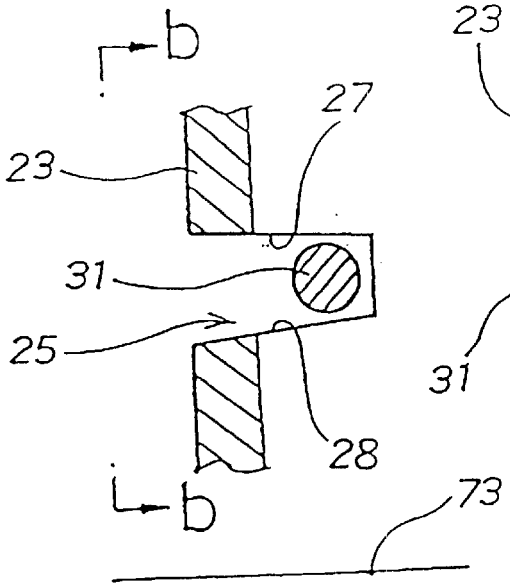
FIG. 14 is a view of a second action of the plug cap attachment structure of the present invention.
Figure 14B:
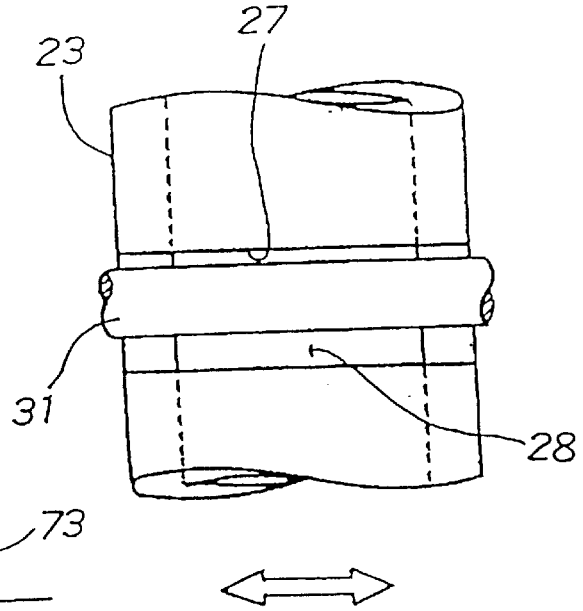
Figure 15A:
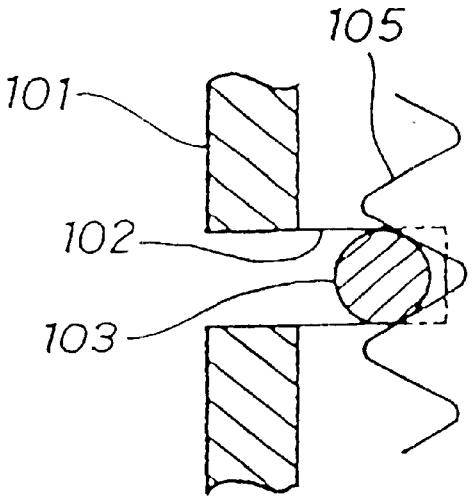
Fig. 15(a) Background Art
FIG. 15 is a view illustrating the operation of a conventional pin member.
Figure 15B:
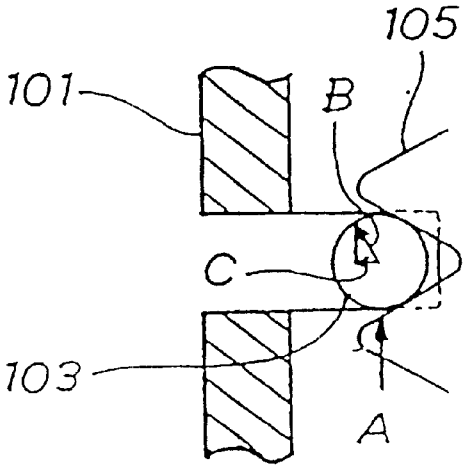
Fig. 15(b) Background Art
Figure 15C:
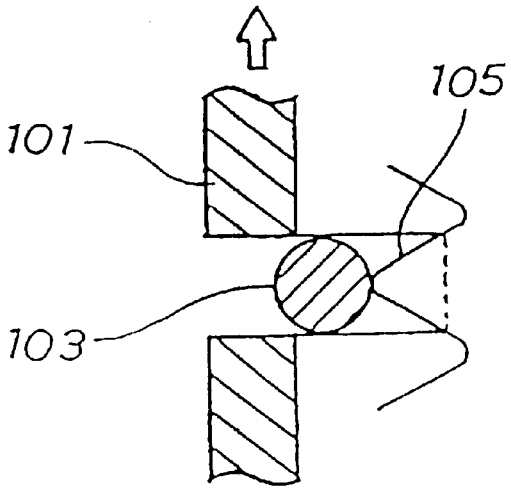
Fig. 15(c) Background Art
Figure 16A:
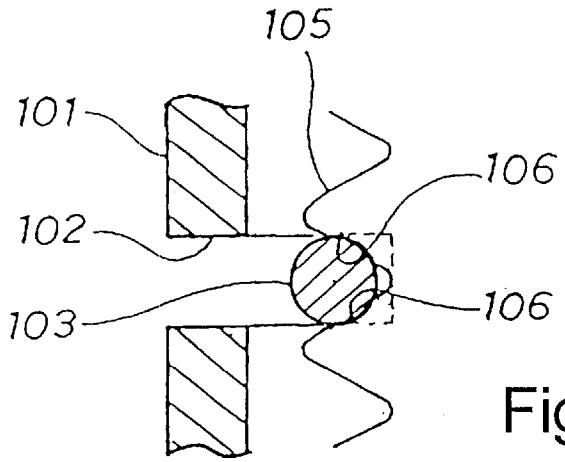
Fig. 16(a) Background Art
FIGS. 16 and 17 are views showing examples of disadvantageous characteristics of a conventional plug cap.
Figure 16B:
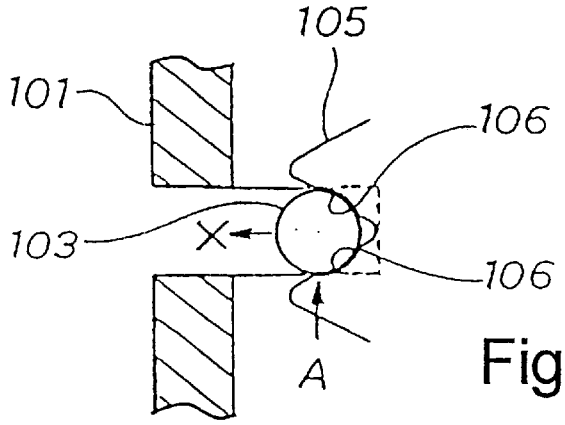
Fig. 16(b) Background Art
Figure 16C:
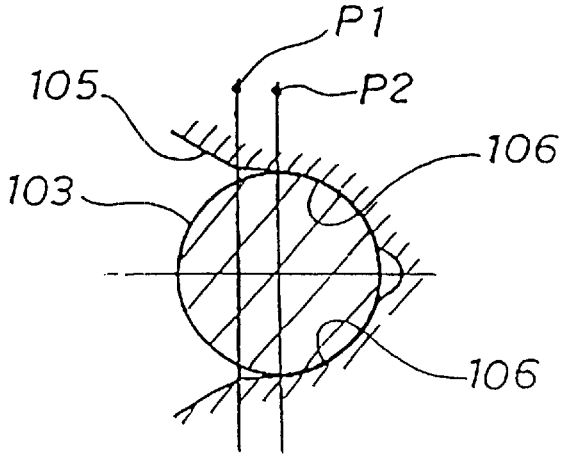
Fig. 16(c) Background Art
Figure 17A:
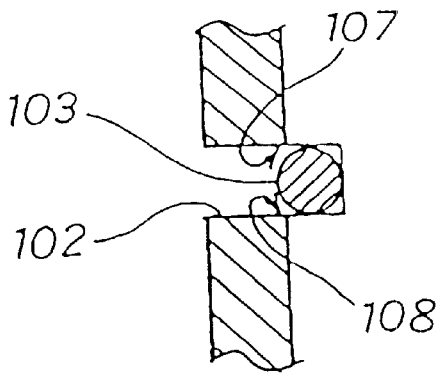
Fig. 17(a) Background Art
Figure 17B:
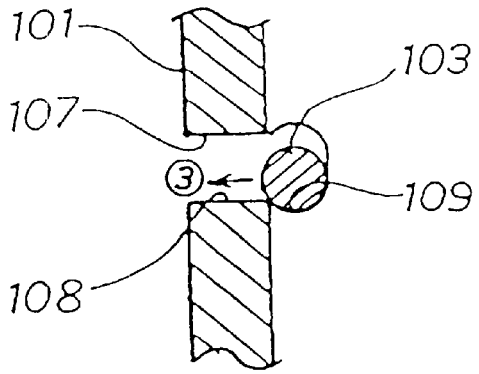
Fig. 17(b) Background Art

FIG. 14(*a*) and FIG. 14(*b*) are views of a second action of the plug cap attachment structure of the present invention. FIG. 14(*a*) is a view showing the relationship of the groove 25 and the straight section 31 of the spring pin as viewed from the front of the vehicle. FIG. 14(*b*) corresponds to FIG. 14(*a*) when viewed from the direction of the arrows b—b, and shows that the direction of vibrations shown by the large arrow coincides with the axial direction of the straight section 31. In this case the straight section 31 moves reciprocally in a direction from front to back of the drawing, and there is no danger of the upper and lower sidewalls 27 and 28 of the groove 25 colliding with the straight section 31.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of attaching a plug cap to a spark plug which is installed within an engine having a principle vibration axis, the method comprising the steps of:

providing a plug cap including a plug cap body, a conductive section provided in said cap body and having at least one groove cut therein, and at least one attachment element provided on the conductive section and having an alignment section;

placing the plug cap on the spark plug; and orienting the alignment section of the at least one attachment element in a direction which is substantially parallel to the principle vibration axis of the engine.

2. The method of attaching a plug cap according to claim 1, wherein the step of orienting the alignment section includes the step of determining the principle vibration axis of the engine.

3. The method of attaching a plug cap according to claim 2, wherein the engine has a crankshaft, the step of determining the principle vibration axis of the engine including the step of determining the direction of the axis of the crankshaft, and the step of orienting the alignment section further including the step of orienting the alignment section in a direction which is substantially orthogonal to the crankshaft axis.

4. The method of attaching a plug cap according to claim 1, wherein the plug cap includes an identifying part on the cap body, the step of orienting the alignment section of the at least one attachment element including the step of aligning the identifying part according to the direction of the principle vibration axis of the engine.

5. The method of attaching a plug cap according to claim 1, wherein the at least one attachment element includes a spring pin, and the alignment section includes a substantially straight section on the spring pin, the step of placing the plug cap on the spark plug including the step of urging the conductive section of the plug cap onto a terminal of the spark plug, the straight section of the spring pin extending through the at least one groove and engaging the spark plug terminal.

6. A method of attaching a plug cap to a spark plug which is installed within an engine having a principle vibration axis, the method comprising the steps of:

providing a plug cap including a cap body, an electrically conductive section attached to said cap body, a groove extending into said conductive section, and an attachment element engaging said groove in said conductive section, said attachment element including an alignment section;

placing the plug cap on the spark plug; and orienting the alignment section of the attachment element in a direction which is substantially parallel to the principle vibration axis of the engine.

7. The method according to claim 6, wherein the attachment element comprises a spring pin, and the alignment section comprises a substantially straight section of the spring pin, the step of placing the plug cap on the spark plug including the step of urging the conductive section of the plug cap onto a terminal of the spark plug, the substantially straight section of the spring pin extending through the groove and engaging the terminal of the spark plug.

8. The method according to claim 7, wherein the engine has a crankshaft, and the step of orienting the alignment section includes the step of orienting the substantially straight section of the spring pin in a direction which is substantially orthogonal to a rotational axis of the crankshaft.

9. The method according to claim 6, further comprising the steps of:

providing the groove with an upper wall, a lower wall, and a rear wall; and orienting the upper wall and lower wall of the groove in non-parallel planes such that the groove decreases in width in a direction progressing inwardly toward the rear wall.

10. The method according to claim 6, wherein the electrically conductive section is substantially cylindrical.

11. The method according to claim 6, wherein the plug cap includes an identifying part on the cap body, and the step of orienting the alignment section of the attachment element includes the step of aligning the identifying part according to the direction of the principle vibration axis of the engine.

12. A method of attaching a plug cap to a spark plug of an engine having a crankshaft, the method comprising the steps of:

providing a plug cap including a cap body, a substantially cylindrical electrically conductive section attached to said cap body, a groove extending into said conductive section, and a spring pin having a substantially straight section engaging said groove;

placing the plug cap on the spark plug by urging the electrically conductive section onto a terminal of the spark plug; and orienting the substantially straight section of the spring pin in a direction which is substantially orthogonal to a rotational axis of the crankshaft.

13. The method according to claim 12, further comprising the steps of:

providing the groove with an upper wall, a lower wall, and a rear wall; and orienting the upper wall and lower wall of the groove in non-parallel planes such that the groove decreases in width in a direction progressing inwardly toward the rear wall.

14. The method according to claim 12, wherein the plug cap includes an identifying part on the cap body, and the step of orienting the substantially straight section of the spring pin includes the step of aligning the identifying part in a predetermined orientation with respect to the rotational axis of the crankshaft.

* * * * *